US010801370B2

(12) United States Patent
Braglia et al.

(10) Patent No.: US 10,801,370 B2
(45) Date of Patent: Oct. 13, 2020

(54) APPARATUS FOR HANDLING A TURBOMACHINE PART

(71) Applicant: NUOVO PIGNONE TECNOLOGIE SRL, Florence (IT)

(72) Inventors: Giacomo Braglia, Florence (IT); Gianpaolo Alvino, Florence (IT); Gianni Mochi, Florence (IT); Andrea Righeschi, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 139 days.

(21) Appl. No.: 15/742,981

(22) PCT Filed: Jul. 8, 2016

(86) PCT No.: PCT/EP2016/066276
§ 371 (c)(1),
(2) Date: Jan. 9, 2018

(87) PCT Pub. No.: WO2017/005901
PCT Pub. Date: Jan. 12, 2017

(65) Prior Publication Data

US 2019/0078471 A1 Mar. 14, 2019

(30) Foreign Application Priority Data

Jul. 9, 2015 (IT) ..... 102015000032260

(51) Int. Cl.
*F01D 25/28* (2006.01)

(52) U.S. Cl.
CPC ..... *F01D 25/285* (2013.01); *F05D 2230/644* (2013.01); *F05D 2230/70* (2013.01); *F05D 2250/232* (2013.01); *F05D 2260/30* (2013.01)

(58) Field of Classification Search
CPC ..... F01D 25/285; F05D 2250/232; F05D 2260/30; F05D 2230/644; F05D 2230/70
See application file for complete search history.

(56) References Cited

U.S. PATENT DOCUMENTS 4,433,830 A * 2/1984 Campbell ..... F01D 25/285 254/264
4,487,014 A * 12/1984 Vinciguerra ..... F02C 7/20 415/220

(Continued)

FOREIGN PATENT DOCUMENTS

EP 0 475 771 A1 3/1992
EP 2 543 868 A2 1/2013

OTHER PUBLICATIONS

Search Report and Written Opinion issued in connection with corresponding IT Application No. 102015000032260 dated Feb. 29, 2016.

(Continued)

*Primary Examiner* — Lawrence Averick
(74) *Attorney, Agent, or Firm* — Baker Hughes Patent Organization

(57) ABSTRACT

An apparatus for handling a turbomachine part, particularly during disassembling and reassembling operations. More specifically, an apparatus for handling the stator cone of a gas turbine suitable to completely manipulate the stator cone during disassembling and reassembling operations. The apparatus allows to disassemble and reassemble the stator cone of a gas turbine without the need to dismount the turbomachine enclosure and without the necessity to have personnel inside the turbomachine package during the operations.

15 Claims, 9 Drawing Sheets

(56) References Cited

U.S. PATENT DOCUMENTS

| | | | | |
|---|---|---|---|---|
| 2009/0173251 | A1* | 7/2009 | Kalantari | F01D 25/285 104/93 |
| 2011/0204006 | A1 | 8/2011 | Jacobs et al. | |
| 2012/0073118 | A1* | 3/2012 | Bywaters | H02K 7/1838 29/596 |

OTHER PUBLICATIONS

International Search Report and Written Opinion issued in connection with corresponding PCT Application No. PCT/EP2016/066276 dated Sep. 8, 2016.

* cited by examiner

APPARATUS FOR HANDLING A TURBOMACHINE PART

BACKGROUND OF THE INVENTION

Embodiments of the present invention relate to an apparatus for handling a turbomachine part, particularly during disassembling and reassembling operations.

More specifically, embodiments of the present invention relate to an apparatus for handling the stator component of a gas turbine suitable to completely manipulate said stator component during disassembling and reassembling operations.

The stator component, having a conical shape and therefore referred to also as stator cone, supports the turbine module and has a sealing function in order to prevent leakage of hot gases. Additionally the stator cone has a function of thermal insulation and separation between the turbine compartment and the exhaust duct.

The gas turbine is usually housed in a housing structure or enclosure. Said enclosure comprises a support structure constituted by a plurality of beams and pillars, said support structure being closed by panels that form lateral walls and the ceiling of the enclosure.

According to the state of the art, an external lifting device, like an overhead crane, is used to lift the stator while disassembling and assembling operations.

A first drawback of the disassembly method according to the prior art is that, in order to access the stator cone from the above, it is necessary to completely disassemble the enclosure in which the turbomachine is housed and also part of the turbine module into which the stator cone is inserted.

A further drawback afflicting the prior art method is the necessity to have personnel inside the turbomachine package during the assembling and disassembling operations. The turbomachine "package" is defined as the space delimited by the turbomachine enclosure.

In fact, the enclosure needs to be completely disassembled while the stator cone is picked up from the above and lifted by an overhead crane, personnel have to hold the stator cone. Due to the geometrical shape of the stator cone, when it is picked up by the overhead crane it is necessary that personnel inside the turbomachine package secures the load to hold it safely while it is moved by crane, in order to avoid dangerous oscillation of the suspended load.

SUMMARY OF INVENTION

Embodiments of the present invention concern an apparatus for handling parts of a turbomachine, particularly during disassembling and reassembling operations, in particular for handling the stator cone of a gas turbine during its disassembling and reassembling, the apparatus being able to grip and allowing the lifting of the stator cone by means of lifting means, i.e. an overhead crane, without the need to completely disassemble the enclosure in which the turbine is contained and without the need to provide for the presence of personnel within the package of the machine.

This technical result translates into a reduction of machine downtime and, therefore, in an economic saving. A further reason of economic saving is obtained both thanks to the shortest time during which the machine remains off and thanks to the fact that the disassembly and reassembly operations are easier, more rapid and require the presence of a lower number of technicians.

Furthermore, the apparatus according to embodiments of the present invention allows dramatically increase the level of safety of the disassembly and reassembly operations of the turbomachine parts, in particular of the stator cone of a gas turbine, since it allows to avoid the presence of people inside of the package of the machine during the operations, allowing to handle the turbine portion in a completely automatic way, the apparatus being, in an embodiment, remotely operated by the personnel which is outside the area of movement of the suspended load, in a more safe condition.

Additionally, the apparatus according to embodiments of the present invention, due to the fact that the turbine part, e.g. the stator cone, is secured to an apparatus part and then lifted by the lifting apparatus, allows the movement of the stator cone in a safer way which avoids the possibility of dangerous oscillations of the appended load.

The object of embodiments of the present invention is to provide an apparatus for disassembling and reassembling a gas turbine part suitable to achieve, among others, the advantages listed above.

BRIEF DESCRIPTION OF THE DRAWINGS

Further details and specific embodiments will refer to the attached drawing, in which:

FIGS. 7, 8, 8A, 9, 9A, 10 and 10A show details of the gripping device of the handling apparatus;

DETAILED DESCRIPTION

The following description of exemplary embodiments refers to the accompanying drawings. The following detailed description does not limit embodiments of the invention. Instead, the scope of embodiments of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
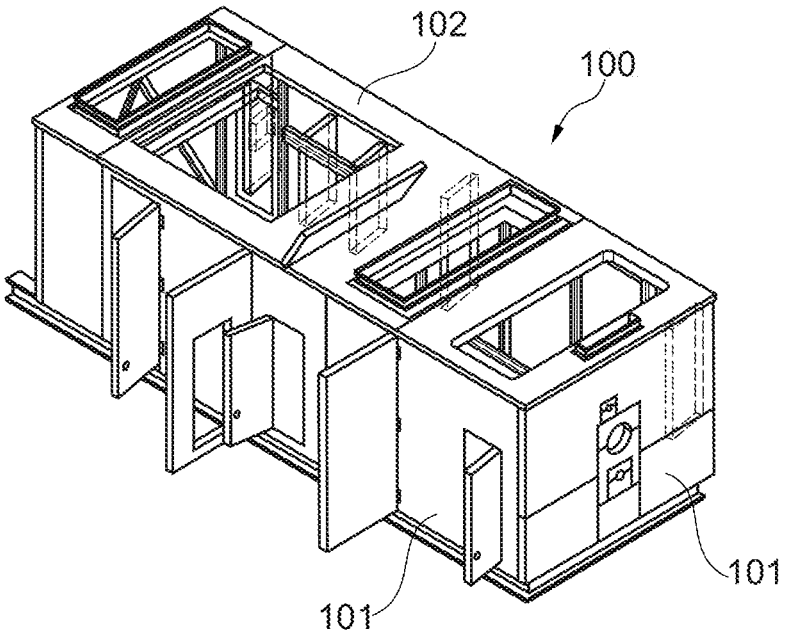
FIG. 1 shows an example of an enclosure containing a gas turbine.
Figure 2:
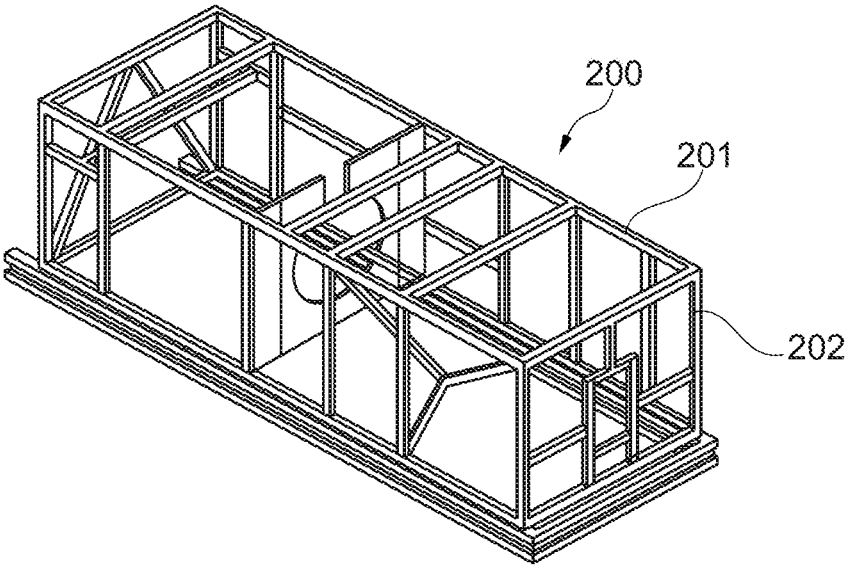
FIG. 2 shows an example of the support structure of the enclosure of FIG. 1.

With reference to FIGS. 1 and 2, a turbomachine, and more particularly a gas turbine 400, is usually housed in an enclosure 100 having lateral walls 101 and a ceiling 102, the enclosure being supported by a supporting structure 200 usually constituted by a plurality of beams 201 and pillars 202.

When it is necessary to proceed with maintenance operations, and in particular when it is necessary to remove the stator cone 300 from the turbomachine 400.

Figure 3:
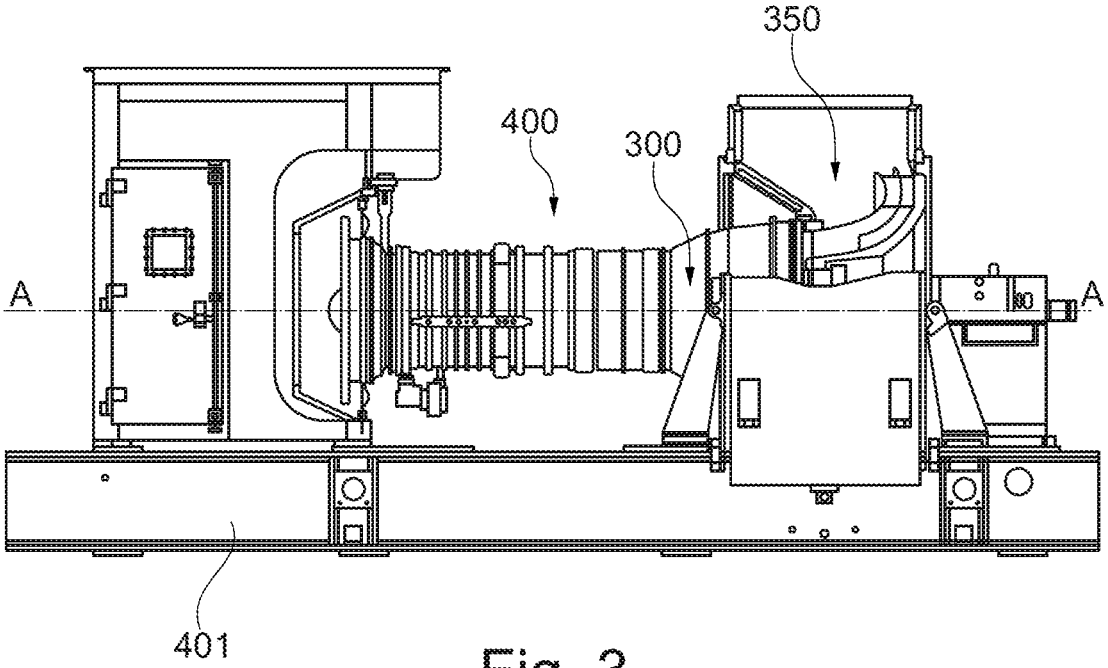
FIG. 3 is a schematic lateral view of a typical turbomachine having a longitudinal axis A.

An example of turbomachine 400 is provided in FIG. 3. With reference to FIG. 3, the turbomachine 400 has a longitudinal axis A, which defines a longitudinal direction Y. The turbomachine 400 is, in an embodiment, placed on a support skid 401.

With reference to FIG. 3, one of the parts of the turbomachine 400 that it is necessary to disassemble while performing maintenance operations on the turbomachine is the stator cone 300. Once the stator cone support structure 350 has been dismounted, the stator cone 300 results still inserted in the enclosure 100 which surrounds the turbomachine 400.

Figures from 11A to 11D show this situation. More in details, FIG. 11A shows that the stator cone 300 is inserted into the enclosure 100 and only part of the stator cone 300 is accessible from the outside of the enclosure.

More in details, a stator cone 300 will comprise a first edge 301, a second edge 302, and a tapered wall 303 comprised between said edges. Due to the conical shape of the stator cone, the first 301 and second 302 edges are substantially circular edges, the first edge 301 having a diameter larger than the second edge 302.

Figure 11A:
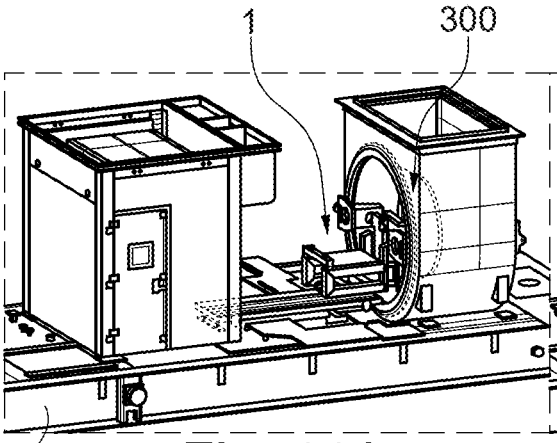
FIGS. 11A, 11B, 11C and 11D show a sequence of operations performed by the handling apparatus.

With reference to FIG. 11A, only the first edge 301 is accessible from the outside of the enclosure when the stator cone 300 is assembled. Therefore, in order to disassemble the stator cone 300 from its operative seat of the turbomachine 400, personnel inside the turbine package has to unscrew the first edge 301 of the stator cone 300 from a stator cone connection flange 101 steadily fixed to the enclosure 100, and while the stator cone 300 is unscrewed from the stator cone connection flange 101 it needs to be supported in the vertical direction Z.

Figure 4:
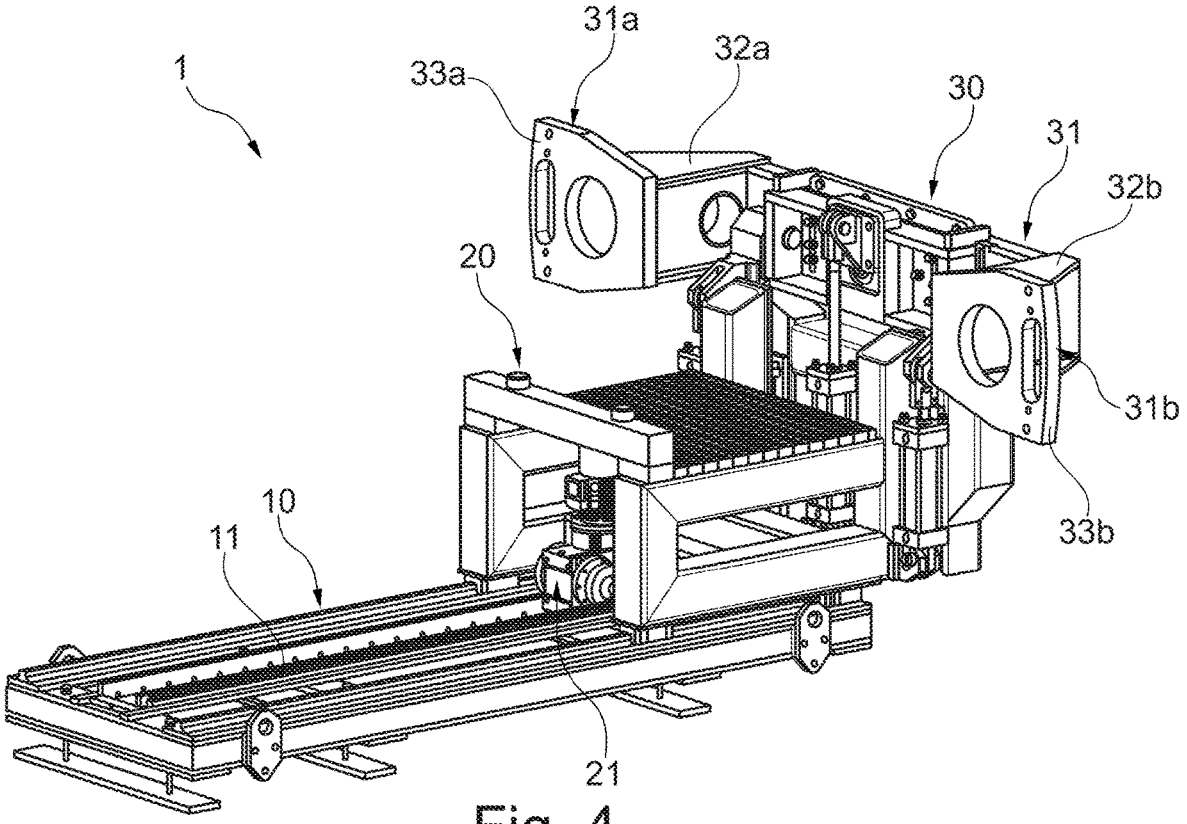
FIGS. 4, 5, 6 and 7 show perspective views of the handling apparatus.
Figure 5:
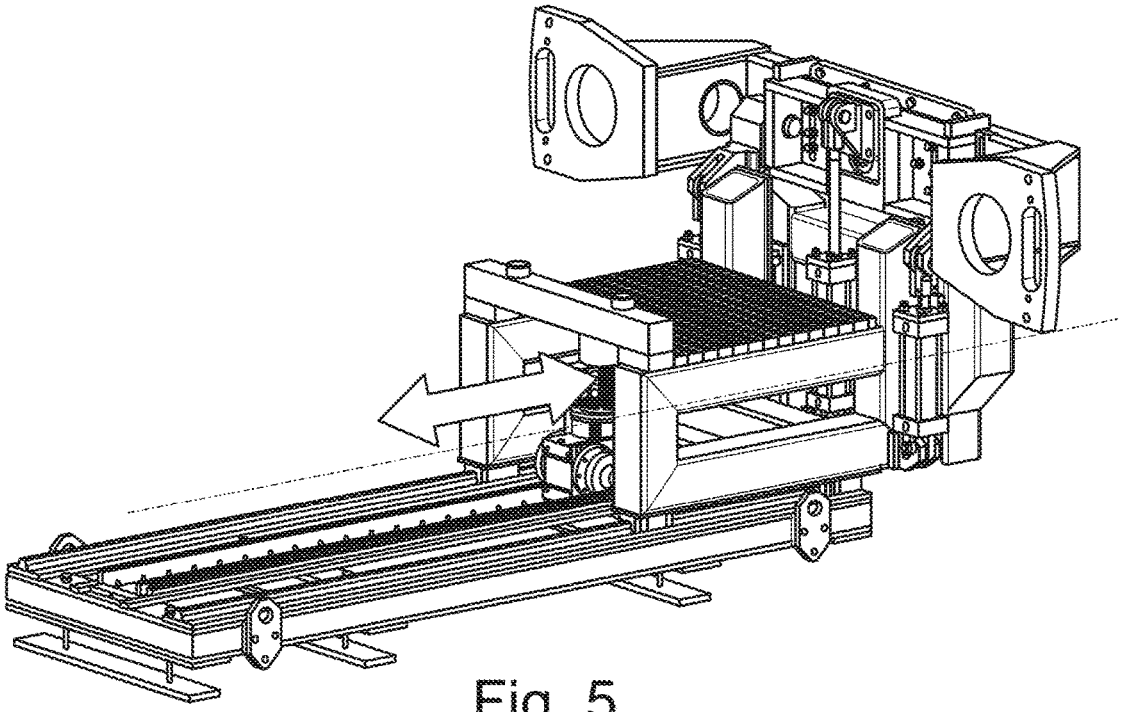

With reference to FIG. 4, according to an embodiment of the present invention an handling apparatus 1 for removing and repositioning a part of a turbomachine from/into its operative seat comprises a base structure 10 comprising a guide element 11 which has a longitudinal extension thus defining a longitudinal direction.

The handling apparatus 1 further comprises a main body 20 movable along said guide element 11 of said base structure 10. The main body 20 is therefore movable along the longitudinal direction defined by said guide element 11.

In an embodiment of the handling apparatus according to embodiments of the present invention shown in the attached drawings, the guide element 11 comprises a rail.

Accordingly, the relative movement of the main body 20 with respect to said rail may, in an embodiment, be actuated by means of a motor truck 21.

The handling apparatus 1 is adapted to be positioned inside the turbomachine package on the turbomachine support skid 401, so that the longitudinal extension of the guide element 11 of the base structure 10 results to be parallel to the longitudinal axis A of the turbomachine 400.

Once the handling apparatus 1 is positioned into the turbomachine package, the movement of the main body 20 along the guide element 11 along the longitudinal axis of the handling apparatus allows to face the first edge 301 of the stator cone 300.

The handling apparatus 1 according to embodiments of the present invention further comprises on said main body, a gripping device 30 adapted to firmly grip the turbomachine part to be handled, for example during assembling and/or disassembling operations.

More in details, with reference to FIG. 4, the gripping device 30 comprises at least a gripping element 31 comprising at least a connection interface adapted to be firmly connected to the part to be handled.

With reference to an embodiment of the present invention disclosed in the attached Figures, a gripping element 31 configured to grip a stator cone 300 of a turbomachine will comprise at least two connection interfaces 31*a*, 31*b*, in an embodiment, provided at the opposite ends of a beam element, so that the connection interfaces 31*a*, 31*b* can be connected at diametrically opposed points of said first edge 301 of the stator cone 300, thus increasing the stability of the hold.

The connection interfaces 31*a*, 31*b* will be screwed to the first edge 301 of the stator cone 300, using the same screw holes already provided on the first edge 301 and used for connecting the store cone 300 to the stator cone connection flange 101.

Three Cartesian axis are shown on FIG. 4. The longitudinal direction corresponds to the Y axis, the transversal direction corresponds to the X axis, the vertical direction corresponds to the Z axis.

Additionally, the reference $\alpha$ refers to a rotation around the transversal axis X, $\beta$ refers to a rotation around the longitudinal axis Y, $\gamma$ refers to a rotation around the vertical axis Z.

As it has been said, in an operative condition the handling apparatus 1 is positioned into the turbomachine package, more in detail on the turbomachine support skid, the longitudinal direction Y of the rail 11 being parallel to the longitudinal axis A of the turbine, and the movement of the main body 20 along the guide element 11 along the longitudinal direction Y, allows to positioning the gripping element 31 of said gripping device 30 facing to the first edge 301 of the stator cone 300. In an embodiment, the gripping element 31 is configured as a beam element having two free ends, comprising the connection interfaces 31*a*, 31*b*, said beam element having a length substantially corresponding to the internal diameter of said first edge 301 of the stator cone 300.

More in details, according to an embodiment of the present invention each of said connection interfaces 31*a*, 31*b* comprises a respective tapered part 32*a*, 32*b* adapted to be inserted into the stator cone 300, more in particular adapted to face and contact the inner surface of the tapered wall 303, and a flanged part 33*a*, 33*b* adapted to be connected to the first edge 301 of the stator cone 300.

The handling apparatus 1 according to embodiments of the present invention, which comprises a gripping device which is movable along a longitudinal direction, is therefore configured to approach the stator cone along the longitudinal direction Y, parallel to the direction of the axis A of the turbomachine, and to grip said stator cone 300 at least at the first edge 301.

Accordingly, with the handling apparatus 1 of embodiments of the present invention, it is not necessary to completely dismount the enclosure in order to remove the stator cone from the gas turbine. On the contrary, the handling apparatus 1 is adapted to grip and firmly constrain the stator cone 300 during the unscrew and disassembly operations necessary to dismount the stator cone form the stator cone connection flange 101.

In an embodiment, the gripping device 30 of the handling apparatus is also movable along a vertical direction Z.

Figure 6:
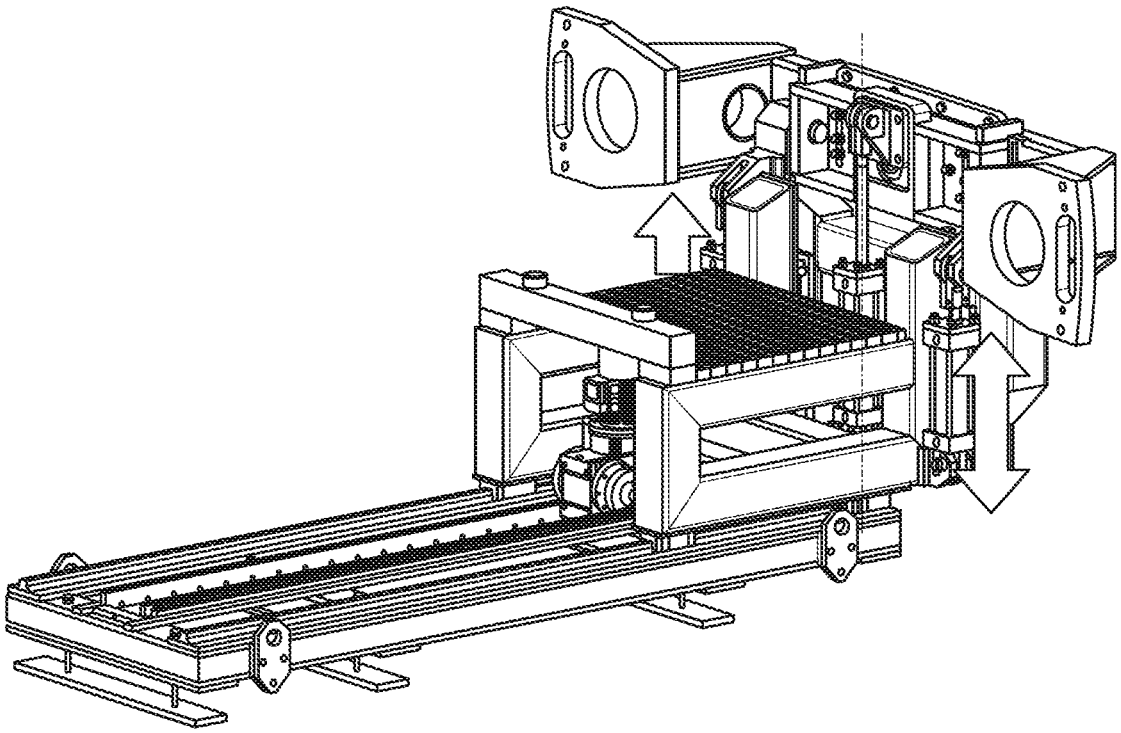

Reference is made to FIG. 6, wherein a vertical arrows indicates the possibility for the gripping device 30 to move along a vertical axis Z.

In an embodiment, the gripping device 30 of the handling apparatus is also pivotable at least about a transversal axis X.

Figure 7:
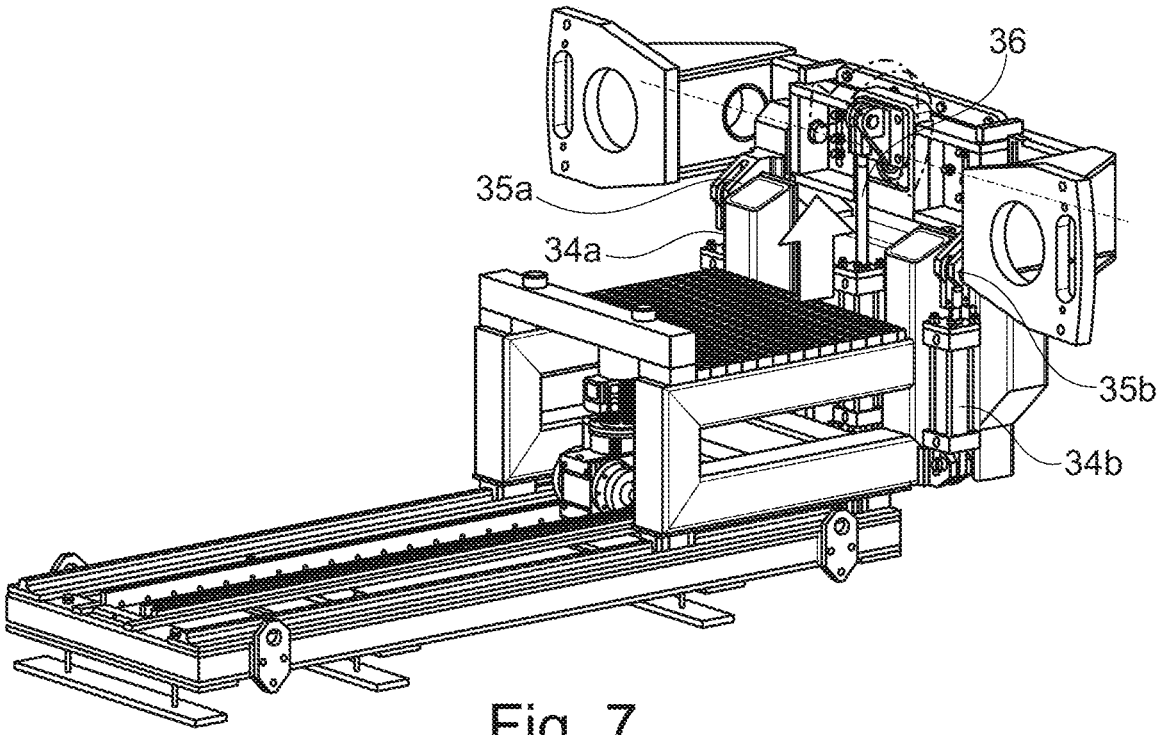

More in details, reference is made to FIGS. 6 and 7, the gripping device 30 is supported by the main body 20 and is movable in the vertical direction Z with respect to said main body 20, and is pivotable about a transversal axis X.

In an embodiment, the vertical movement along the Z direction and the rotation about the transversal axis X of the gripping device 30, are obtained by means of a plurality of actuators, in an embodiment, pneumatic actuators 34*a*, 34*b*, 36.

The gripping device is configured to move and pivot the turbomachine part 300 with respect to the base structure 10. In particular, through the actuators 34*a*, 34*b*, 35 the handling apparatus 1 can move the part 300 along the direction Z and pivot it about the axis X.

In an embodiment, said actuators comprise a couple of actuators 34*a*, 34*b* each oriented substantially along the vertical direction Z and having one end connected to said main body 20 and the other end hinged at hinge points 35*a*, 35*b* provided on a part of said gripping device 30.

A further pivoting actuator 35 for pivoting the gripping device 30 around the transversal axis X acts between said main body 20 and said gripping device 30. The pivoting actuator 35 is hinged to a portion of said gripping device 30 so that when said pivoting actuator 35 is actuated, a rotation of the gripping device 30 around the transversal axis X passing through the hinges 35*a*, 35*b* is obtained.

Accordingly, when it is necessary to move the gripping device 30 with respect to the main body 20 along the vertical direction Z, both the vertical actuators 34*a*, 34*b* and the pivoting actuator 35 are actuated simultaneously.

In an embodiment, the gripping device 30 of the handling apparatus 1 according to embodiments of the present invention is further pivotable about a vertical axis Z.

With reference to figures from 14 to 16, in order to allow a fine alignment of the gripping device 30 with respect to the part to be handled, three separated frames with independent degrees of freedom are provided. According to an embodiment, the gripping device 30 of the handling apparatus according to embodiments of the present invention comprises a first frame 37, a second frame 38 and a third frame 39.

Figure 8:
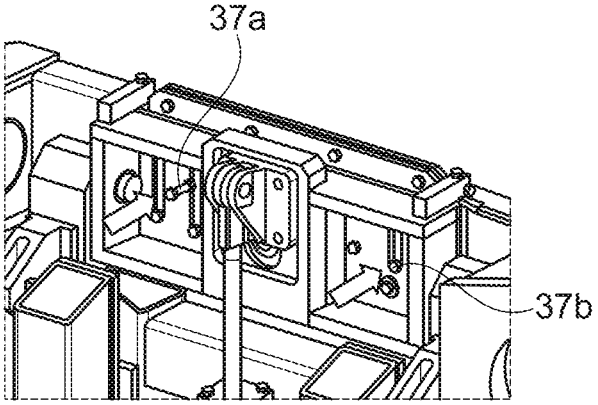
Figure 8A:
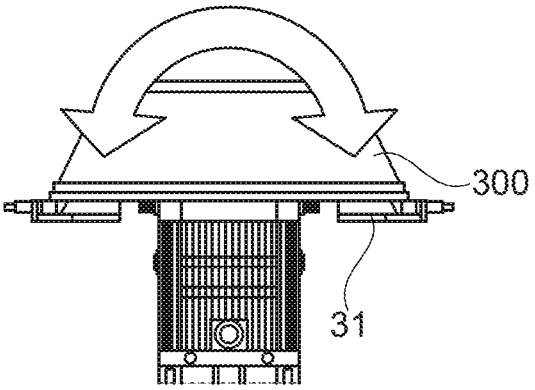

With reference to FIGS. 8 and 8A, said first frame 37 comprises a first fine regulation device, e.g. controlled by a first couple of screws 37*a*, 37*b* manually operable, which allows the fine adjustment of the gripping device 30 around the vertical axis Z. More in details, the first fine regulation device acts, through the first couple of screws 37*a* and 37*b*, on the second 38 and third 39 frames, adjusting the angular position of the second 38 and third 39 frames around the vertical axis Z.

In an embodiment, the gripping device 30 of the handling apparatus 1 according to embodiments of the present invention is further pivotable about a longitudinal direction Y.

Figure 9:
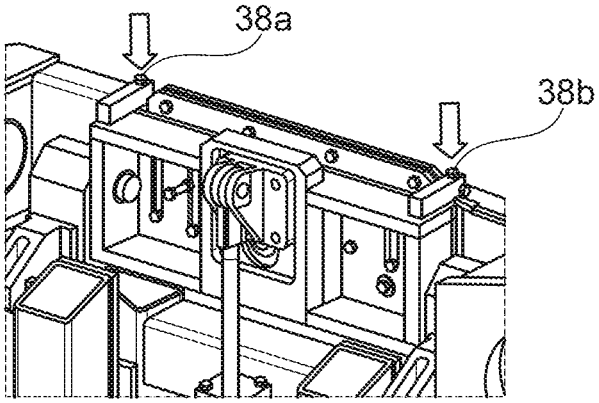
Figure 9A:
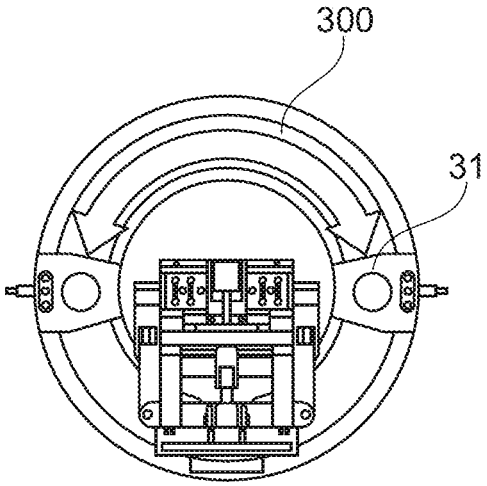

With reference to FIGS. 9 and 9A, said first frame 37 further comprises a second fine regulation device, e.g. controlled by a second couple of screws 38*a*, 38*b* manually operable, which allows the fine adjustment of the gripping device 30 around the longitudinal direction Y. More in details, the second fine regulation device allows the fine rotation around the longitudinal direction Y of the second frame 38 with respect to the first frame 37, the rotation of the second frame 38 implies the rotation also of the third frame 39.

The gripping device 30 of the handling apparatus according to embodiments of the present invention, is therefore connected to said main body 20 by means of a spherical joint, allowing three angular degree of freedom, allowing the rotations $\alpha$ about the transversal axis X, $\beta$ about the longitudinal axis Y, and $\gamma$ about the vertical direction Z.

Figure 15:
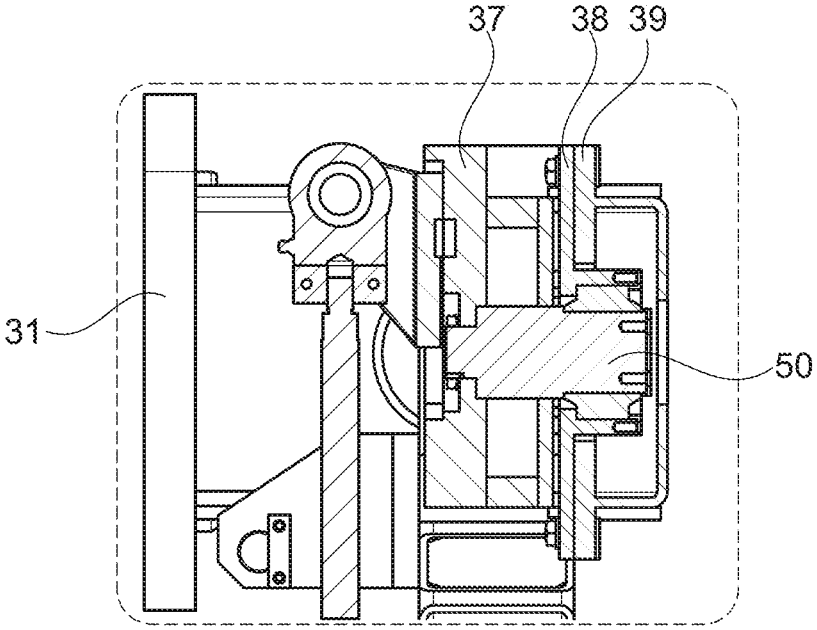
FIG. 15 represents a schematic and enlarged view of the gripping device of the apparatus.
Figure 16:
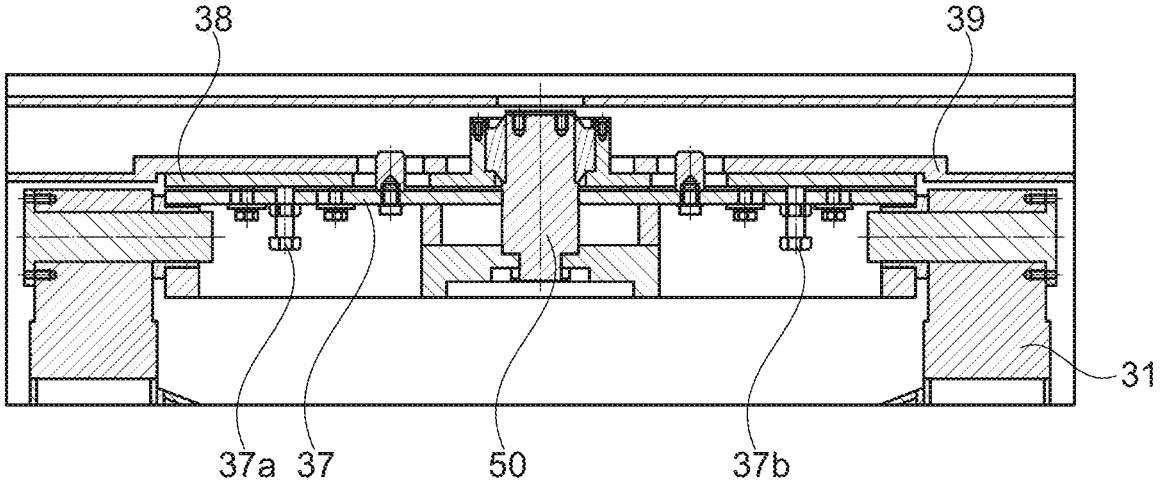
FIG. 16 represents a detail of the spherical joint provided between the main body and the gripping element of the handling apparatus.

The spherical joint 50 provided between the first frame 37 and the second 38 and third 39 frames is shown in the schematic cross section of FIG. 15.

More in details, the planar spherical joint 50 allows the relative movements of the second 38 and third 39 frames with respect to the first frame 37.

In an embodiment, the gripping device 30 of the handling apparatus 1 according to embodiments of the present invention is further movable along the transversal direction X.

Figure 10:
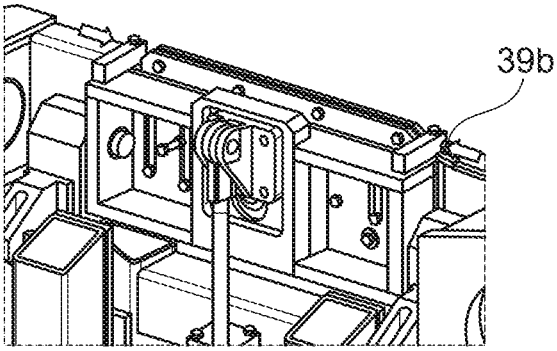
Figure 10A:
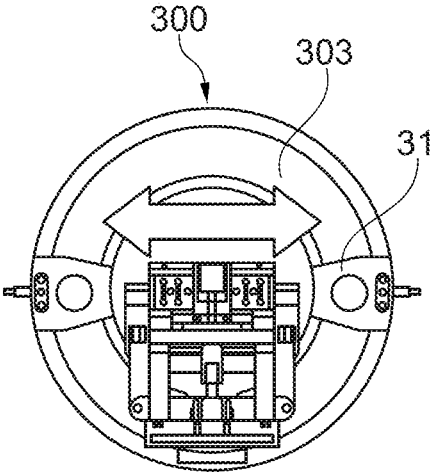

With reference to FIGS. 10 and 10A, said first frame 37 further comprises a third fine regulation device, e.g. controlled by a third couple of screws 39*a*, 39*b* manually operable, which allows fine adjustment of the gripping device 30 along the transversal direction X. More in details, when the third fine regulation device is actuated, the third frame 39 is moved along the transversal direction X with respect to the first 37 and second 38 frames.

The gripping device 30 of the handling apparatus 1 according to embodiments of the present invention, therefore has six degrees of freedom in the space: the translation movement along the longitudinal direction Y, the translation movement along the vertical direction Z, the translation movement along the transversal direction X, the rotation $\alpha$ about the transversal axis X, the rotation $\beta$ about the longitudinal axis Y and the rotation $\gamma$ about the vertical axis Z.

As it has been said, once the handling apparatus 1 is positioned into the turbomachine package, the movement of the main body 20 along the guide element 11 along the longitudinal direction Y, allows to positioning the gripping element 31 of the gripping device 30 facing to the first edge 301 of the stator cone 300. Once the gripping element 31 faces the stator cone 300, it is partially inserted into the stator cone 300 and its connection interfaces 31*a*, 31*b* are firmly connected to said first edge 301 of the stator cone 300.

In order to reach the correct position of the gripping element 31 with respect to the first edge 301, may be necessary to adjust the position of the gripping device 30 also by means of a fine regulation of the position along the vertical axis Z, along the transversal axis X, and by means of a fine rotation of the gripping element 31 about the vertical axis Z and the transversal axis X.

Figure 11B:
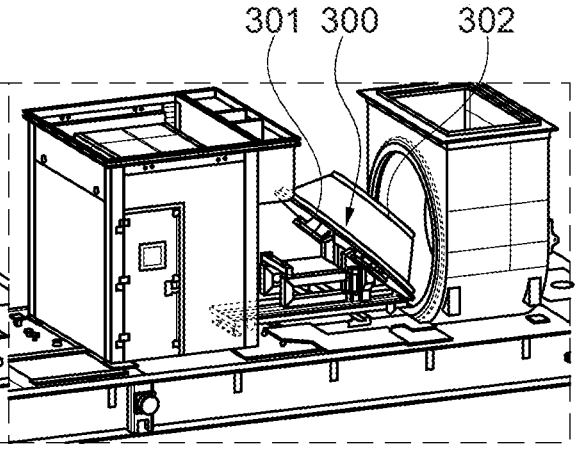
Figure 11C:
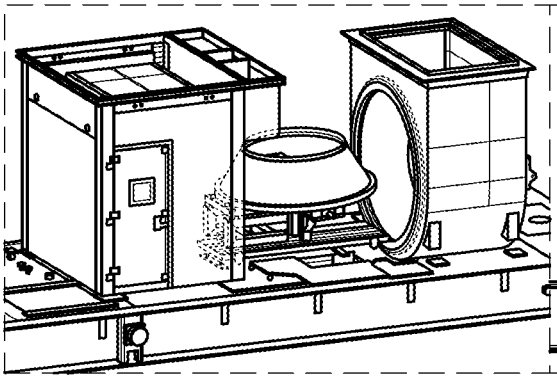

Once the gripping element 31 is connected to the first edge 301 of the stator cone 300, the gripping element 31 is pivoted about the transversal axis X thus pivoting the stator cone 300 from its substantially vertical position when it is positioned in its operative seat, to a substantially horizontal position, wherein the first edge 301 lies in a substantially horizontal plane XY and the main body 20 can be moved backwardly away from the stator cone connection flange 101. The situation is shown in FIGS. 11B and 11C.

In an embodiment, a lifting device 40 may be associated to the handling apparatus 1 of embodiments of the present invention. More in details, said lifting device 40 is configured to be associated to the stator cone 300 and comprises a lifting eyelet 41 suitable to be hooked by a lifting hook of said lifting means, e.g. an overhead crane.

Figure 13:
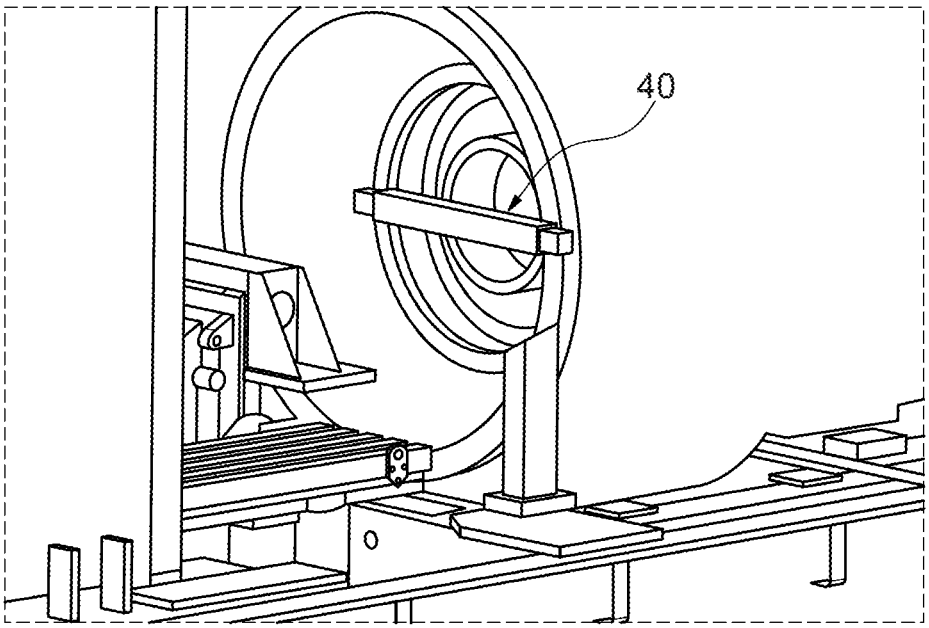
FIG. 13 shows a detail of the turbomachine part to be disassembled connected to the lifting device of FIG. 12.
Figure 14:
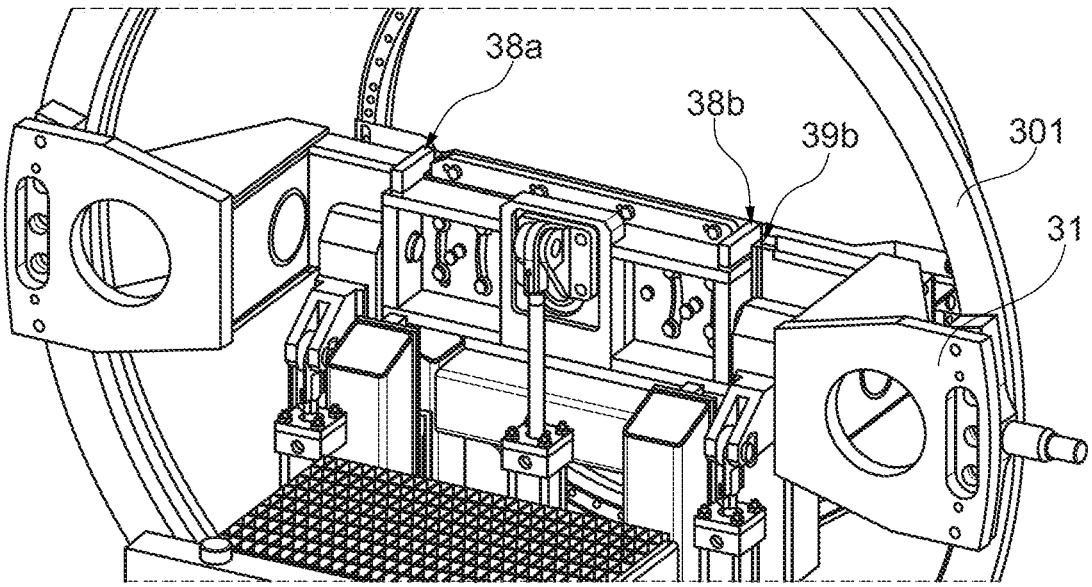
FIG. 14 represents an enlarged view of the gripping device of the handling apparatus.

Said lifting device comprises a spreader bar 40 having a length adapted to be inserted transversely inside the stator cone 300 and at least an eyelet 41 suitable to be hooked. FIG. 13 shows the lifting device 40 inserted into the stator cone 300.

Figure 12:
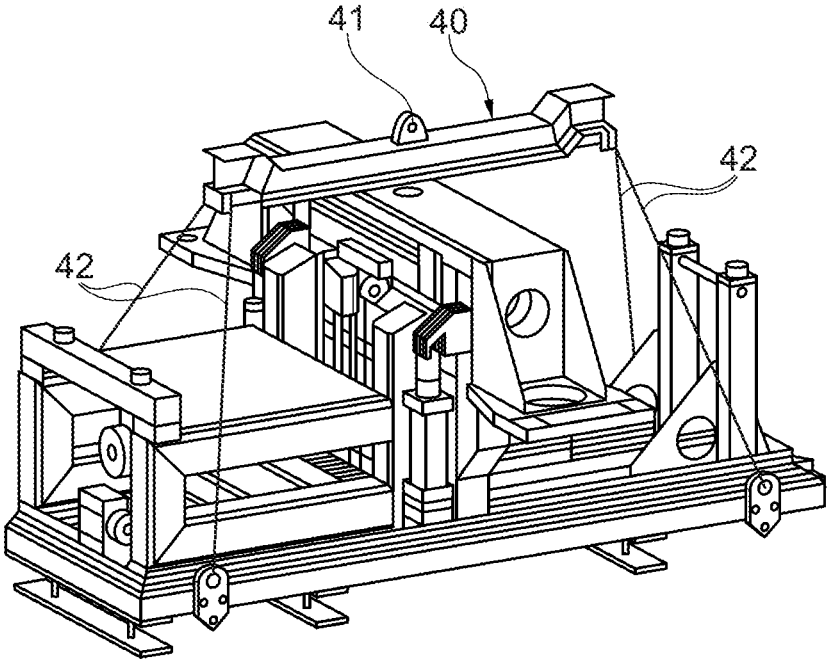
FIG. 12 shows a perspective view of the handling apparatus associated to a lifting device.

In an embodiment, said lifting device 40 may also be associated to the handling apparatus 1 of embodiments of the present invention, e.g. by means of wires or ropes 42 as disclosed in FIG. 12, thus allowing the lifting of the handling apparatus itself.

Once the handling apparatus is lifted and positioned inside the enclosure, the spreader bar 40 is disconnected from the handling apparatus and installed inside the stator cone 300.

Once the spreader bar 40 is connected to the stator cone 300, the handling apparatus 1 according to embodiments of the present invention is fixed to the cone.

Once the gripping element 31 is connected to the first edge 301 of the stator cone 300 and is pivoted about the transversal axis X thus pivoting the stator cone 300 from its substantially vertical position to a substantially horizontal position, wherein the first edge 301 lies in a substantially horizontal plane XY, the main body 20 is moved backwardly away from the stator cone connection flange 101.

Figure 11D:
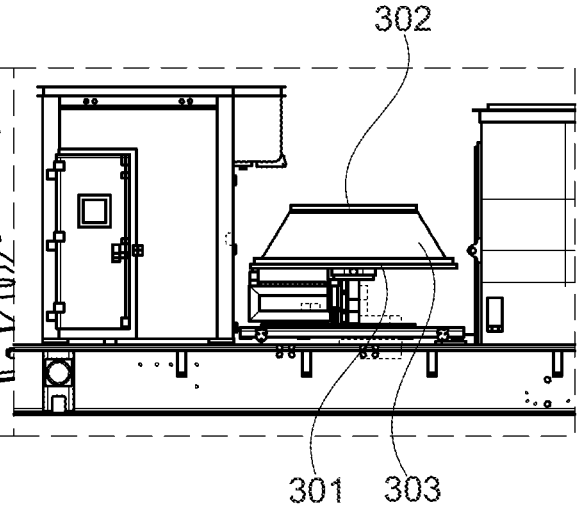

Now the stator cone 300 is extracted from it operative and is placed horizontally, supported by the gripping element 31 of the main body 20. The reference is to FIG. 11D.

In order to safely lift the stator cone 300, the gripping element 31 is uncoupled from the stator cone and the lifting device 40 can be hooked by the hooked by the lifting hook of said lifting means, e.g. an overhead crane.

Therefore, the handling apparatus of embodiments of the present invention allows to extract the turbomachine part from its operative seat and to lift it without disassembling the turbomachine enclosure.

The handling apparatus 1 according to embodiments of the present invention is also adapted to reposition the stator cone 300 in its operative seat during reassembling operations.

All the operations of the handling apparatus 1 according to embodiments of the present invention are, in an embodiment, remotely controlled by means of remote controls, so that it is possible to remove and repositioning the turbomachine part from/to the turbomachine without the need to have personnel in the operative area of the handling apparatus while it is moving.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A handling apparatus for removing and repositioning a turbomachine part from/into its operative seat, the turbomachine defining a longitudinal axis and housed within a turbomachine enclosure supported by a support structure, the apparatus comprising:

a base structure comprising a guide element developing along a longitudinal direction, the base structure housed within the turbomachine enclosure and positioned on the support; and a main body movable along the guide element;

wherein, in an operative condition of the handling apparatus, the longitudinal direction of the guide element is arranged within the turbomachine enclosure parallel to the longitudinal axis of the turbomachine, the main body comprising a gripping device configured to be connectable to the turbomachine part;

wherein the gripping device is rotatable at least about a transversal horizontal axis, and is also movable at least along a vertical direction, the rotation about the transversal horizontal axis and the movement along the vertical direction and of the gripping device being obtained by means of a plurality of actuators.

2. The handling apparatus according to claim 1, wherein the gripping device is configured to pivot the connectable turbomachine part about the transversal axis with respect to the base structure.

3. The handling apparatus according to claim 2, wherein the gripping device is pivotable about a transversal horizontal axis passing through at least one hinge point provided on the gripping device.

4. The handling apparatus according to claim 3, wherein the apparatus further comprises one or more of the actuators, each oriented substantially along the vertical direction and having one end connected to the main body and the other end hinged at one of the one or more hinge points.

5. The handling apparatus according to claim 4, wherein the apparatus further comprises at least a pivoting actuator acting between the gripping device and the main body and configured for pivoting the gripping device around the transversal axis passing through the one or more hinge points.

6. The handling apparatus according to claim 1, wherein the gripping device is configured to move the connectable turbomachine part along the vertical direction with respect to the base structure.

7. The handling apparatus according to claim 1, wherein the gripping device is further pivotable about a vertical axis.

8. The handling apparatus according to claim 1, wherein the gripping device is further pivotable about a longitudinal horizontal axis.

9. The handling apparatus according to claim 1, wherein the gripping device is connected to the base structure by means of a spherical joint.

10. The handling apparatus according to claim 1, wherein the turbomachine part to be handled is a stator component of a gas turbine, the stator component having a conical shape comprising a first edge, a second edge, and a tapered wall comprised between the edges, and the gripping device further comprising a gripping element configured to be connectable to the first edge of the stator cone.

11. The handling apparatus according to claim 10, wherein the gripping element comprises at least two connection interfaces connectable at diametrically opposed points of the first edge of the stator cone.

12. The handling apparatus according to claim 11, wherein each of the at least two connection interfaces comprises a tapered part to be insertable into the stator cone.

13. The handling apparatus according to claim 1, wherein a spherical joint connects the gripping element to the main body.

14. The handling apparatus according to claim 13, wherein the gripping element further comprises a first frame connected to the main body and supporting a second and a third frame, the spherical joint allowing the relative movement of the second and third frames with respect to the first frame.

15. The handling apparatus according to claim 1, the handling apparatus is housed inside the turbomachine enclosure and configured to enable removal and repositioning of the turbomachine part from/into its operative seat within the enclosure without a need to disassemble the enclosure.

* * * * *